US008324993B2

(12) United States Patent
Naka et al.

(10) Patent No.: US 8,324,993 B2
(45) Date of Patent: Dec. 4, 2012

(54) ELECTROMAGNETIC CONTACT DEVICE

(75) Inventors: Yasuhiro Naka, Kounosu (JP); Toshikatwsu Ohgami, Kounosu (JP); Koji Okubo, Kumagaya (JP); Kouetsu Takaya, Kounosu (JP); Kenji Suzuki, Kounosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/138,926

(22) PCT Filed: Jun. 14, 2010

(86) PCT No.: PCT/JP2010/003936

§ 371 (c)(1),
(2), (4) Date: Jan. 4, 2012

(87) PCT Pub. No.: WO2011/021334

PCT Pub. Date: Feb. 24, 2011

(65) Prior Publication Data

US 2012/0139673 A1 Jun. 7, 2012

(30) Foreign Application Priority Data

Aug. 20, 2009 (JP) ..... 2009-190587

(51) Int. Cl.
*H01H 67/02* (2006.01)

(52) U.S. Cl. ..... 335/132

(58) Field of Classification Search ..... 335/132, 335/129, 185

See application file for complete search history.

(56) References Cited

U.S. PATENT DOCUMENTS

| | | | | | |
|---|---|---|---|---|---|
| 1,408,632 | A * | 3/1922 | Parker | 335/265 |
| 2,658,961 | A * | 11/1953 | Fisher | 200/1 A |
| 2,794,882 | A * | 6/1957 | Russell | 335/131 |
| 3,277,410 | A * | 10/1966 | Faffart et al. | 335/132 |
| 3,671,891 | A * | 6/1972 | Yushito Usui et al. | 335/126 |
| 3,882,435 | A * | 5/1975 | Grass et al. | 335/164 |
| 4,490,701 | A * | 12/1984 | Dietrich et al. | 335/78 |
| 4,509,026 | A * | 4/1985 | Matsushita | 335/85 |
| 4,916,421 | A * | 4/1990 | Pardini et al. | 335/185 |
| 4,947,146 | A * | 8/1990 | Ichimura et al. | 335/131 |
| 5,014,027 | A * | 5/1991 | Ootsuka | 333/132 |
| 5,059,930 | A * | 10/1991 | Ootsuka | 335/131 |
| 5,075,660 | A * | 12/1991 | Ootsuka | 335/131 |
| 5,081,436 | A * | 1/1992 | Nishi et al. | 335/83 |
| 7,091,805 | B2 * | 8/2006 | Kawahara et al. | 335/132 |
| 2001/0045878 | A1 * | 11/2001 | Fausch | 335/129 |

FOREIGN PATENT DOCUMENTS

| | | |
|---|---|---|
| JP | S56-128533 | 10/1981 |
| JP | U-S62-144039 | 9/1987 |
| JP | S64-048339 | 2/1989 |
| JP | H03-110733 | 5/1991 |
| JP | U H06-086245 | 12/1994 |

* cited by examiner

*Primary Examiner* — Elvin G Enad
*Assistant Examiner* — Alexander Talpalatski
(74) *Attorney, Agent, or Firm* — Manabu Kanesaka

(57) ABSTRACT

Within a case (4), are accommodated an electromagnet (8) having a fixed core (8*c*) and a movable core (8*d*) capable of contacting and separating from the fixed core (8*c*); a movable contact point support (7*a*) which moves in parallel with the movable core; a return spring (7*b*) which causes the movable contact point support to return to an initial position; and a driving lever (9) which rotates with a rotation support point portion (9*a*) provided on one end thereof as a support point, and which transmits attraction movement and release movement of the movable core to the movable contact point support. The rotation support point portion of the driving lever is fitted into and supported by a support point recess (5*a*) provided in an inner face of an extinction cover (5) mounted on the case.

6 Claims, 9 Drawing Sheets

ELECTROMAGNETIC CONTACT DEVICE

RELATED APPLICATIONS

The present application is National Phase of International Application No. PCT/JP2010/003936 filed Jun. 14, 2010, and claims priority from, Japanese Application No. 2009-190587, filed Aug. 20, 2009.

TECHNICAL FIELD

The invention relates to an electromagnetic contact device, and more specifically relates to a driving lever which transmits attraction movement and release movement of a movable core of an electromagnet to a movable contact point support.

BACKGROUND ART

The device of Patent Reference 1 is for example known as an electromagnetic contact device.

In the electromagnetic contact device of this Patent Reference 1, an electromagnet, a movable contact point support arranged parallel to the electromagnet, a return spring which urges the movable contact point support toward an initial position, and a driving lever which transmits attraction movement and release movement of the electromagnet to the movable contact point support, are accommodated within a case.

The movable contact point support comprises a plurality of movable contact points, which moves against the return spring to perform open or close operations with fixed contact points arranged within the case in opposition to each of the movable contact points. The electromagnet comprises an excitation coil, a fixed core, and a movable core arranged in opposition to and capable of contacting and separating from the fixed core. The center portion in the length direction of the driving lever is axially supported via a pin within the case, one end is engaged with the movable contact point support, and another end is engaged with the movable core.

When the excitation coil of the electromagnet is in an excited state and the movable core of the electromagnet is attracted to the fixed core, the movement due to attraction of the movable core is transmitted to the driving lever, which rotates about the pin via a movable core conjoining portion. This rotation of the driving lever is transmitted to the movable contact point support via a movable contact point support conjoining portion, and the movable contact point support moves from the initial position to an operation position, so that each of the corresponding movable contact points and fixed contact points perform open and close operations. Further, when the excitation coil of the electromagnet enters a non-excited state, the urging force of the return spring causes the movable contact point support to move from the operation position to the original position.

In the device of Patent Reference 1, even when an excessive current flows and slight adhesion between movable contact points of the movable contact point support at the operation position and fixed contact points occurs so that the movable contact point support does not move to the initial position against the urging force of the return spring, the inertial force of the movable core which is pressed by the urging force of the return spring to perform release movement is transmitted via the driving lever as a force moving the movable contact point support to the initial position. This force acts as a force to pull apart the slightly adhering movable contact points and fixed contact points, and the movable contact point support can return to the initial position, so that even when excessive current flows, the electromagnetic contact device can operate normally.

Patent Reference 1: Japanese Patent Laid-open No. 556-128533 (FIG. 4)

In the electromagnetic contact device of Patent Reference 1, the driving lever is conjoined with the case via the pin, so that there is a problem that the time required for driving lever assembly is increased.

Further, in Patent Reference 1, the point of action of the driving lever transmitting movement of the movable core to the movable contact point support does not coincide with the line of action (line extending from the axial line) of the return spring applying a urging force to the movable contact point support, so there is a concern that a moment may be imparted to the moving movable contact point support, and there is a concern that sliding friction with the case may increase.

This invention focuses on the above unresolved problems of examples of the prior art, and has as an object of providing an electromagnetic contact device which enables removal, by normal operation, of the problem of light adhesion of contact point portions due to the flow of excessive current, and enables easy assembly of the driving lever linking the movable contact point support and the electromagnet, and in which moreover the movable contact point support can be operated without the occurrence of a moment.

DISCLOSURE OF THE INVENTION

In order to attain the above object, the electromagnetic contact device of one embodiment has a case accommodating an electromagnet having a movable core for attraction movement and release movement, a movable contact point support moving between an initial position and an operation position in parallel with a moving direction of the movable core, a return spring urging this movable contact point support toward the initial position, and a driving lever which is engaged with the movable core and the movable contact point support, and transmits the attraction movement of the movable core to the movable contact point support as a moving force toward the operation position. The electromagnetic contact device is configured such that a lever holding portion is formed in an inner wall of an extinction cover, and by mounting this extinction cover on the case and having the lever holding portion to axially support one end of the driving lever, the driving lever is accommodated such that another end thereof engaged with the movable core and movable contact point support rotates with the one end as a rotation support point. When the movable contact point support halts midway during release, the release movement due to inertial force of the movable core is transmitted to the movable contact point support via the driving lever as a moving force toward the initial position.

Here, the release movement due to inertial force of the movable, core is a movement of the movable contact point support, wherein the movable contact point support pressed to the initial position side by the urging force of the return spring is transmitted via the driving lever to the movable core, so that the movable core performs release movement. Thus, even if the movable contact point support is halted, the movable core performs release movement due to the force of inertia.

By means of the electromagnetic contact device of this embodiment, a pin or other rotation support member fixed in the case, as in a structure of the prior art, is unnecessary, so that the number of components required for assembly of the driving lever can be reduced. Further, even when the movable contact point support halts midway during release due to slight adhesion of the movable contact points and fixed contact points caused by flow of an excessive current, release movement due to inertial force of the movable core is transmitted via the driving lever to the movable contact point support as a moving force directed toward the initial position, so that the slightly adhering movable contact points and fixed contact points are immediately pulled apart, and slight adhesion of contact points can be removed in normal operation of the electromagnetic contact device.

Further, in the electromagnetic contact device of one embodiment, a point of action of the driving lever, which transmits the attraction movement of the movable core to the movable contact point support as the moving force, is positioned on a line extending from an axial line of the return spring.

By means of the electromagnetic contact device of this embodiment, a moment does not act on the movable contact point support to which a force is transmitted from the point of action of the return spring and driving lever, the sliding friction of the movable contact point support with the case interior can be reduced, and the durability of the movable contact point support can be improved.

Further, in the electromagnetic contact device of one embodiment, a movable core engaging hole is formed in the movable core, and another end of the driving lever is inserted into and engaged with this movable core engaging hole, and in the vicinity of an inner face of the movable core engaging hole with which another end is engaged, a first-contact portion which abuts the an other end before the inner face is formed when the movable core performs the release movement due to the inertial force.

By means of the electromagnetic contact device of this embodiment, when the movable core performs release movement due to inertial force, another end of the driving lever immediately abuts the first-contact portion formed in the movable core engaging hole. By this means, the operation of pulling apart the slightly adhering movable contact points and fixed contact points can be performed early.

Further, in the electromagnetic contact device of one embodiment, the shape of a tip portion of the driving lever inserted into the movable core engaging hole is made a narrow tip shape with an area smaller than an opening area of the movable core engaging hole. By means of the electromagnetic contact device of this embodiment, the task of engagement of the driving lever with the movable core is facilitated.

Further, in the electromagnetic contact device of one embodiment, another end of the driving lever is bent in the moving direction of the movable core and inserted into the movable core engaging hole to be in proximity to the inner face of the movable core engaging hole positioned in the moving direction of the movable core.

By means of the electromagnetic contact device of this embodiment, another end of the driving lever is in proximity to the inner face of the movable core engaging hole positioned in the moving direction of the movable core, so that attraction movement and release movement due to inertial force of the movable core are immediately transmitted to the movable contact point support.

Also, in the electromagnetic contact device of one embodiment, the lever holding portion formed in the inner wall of the extinction cover is a recess supported by entering the one end of the driving lever.

By means of the electromagnetic contact device of this embodiment, the one end of the driving lever can be axially supported so as to become a rotation support point by the recess of a simple structure formed in an inner wall of the extinction cover.

By means of an electromagnetic contact device of this invention, a pin or other rotation holding member fixed in the case, as in a structure of the prior art, is unnecessary, so that the components necessary for assembly of the driving lever can be reduced. Further, even when the movable contact point support halts midway during release due to slight adhesion of contact point portions caused by the flow of excessive current, the release movement of the movable core due to inertial force is transmitted to the movable contact point support via the driving lever as a moving force directed toward the initial position, and the slightly adhering contact point portions are immediately pulled apart, so that slight adhesion of contact points can be removed in normal operation of the electromagnetic contact device.

Also, when the point of action of the driving lever is positioned on the line extending from the axial line of the return spring, a moment does not act on the movable contact point support to which force is transmitted from the point of action of the return spring and driving lever, so that sliding friction of the movable contact point support with the case interior can be reduced, and the durability of the movable contact point support can be improved.

BEST MODE FOR CARRYING OUT THE INVENTION

Figure 1:
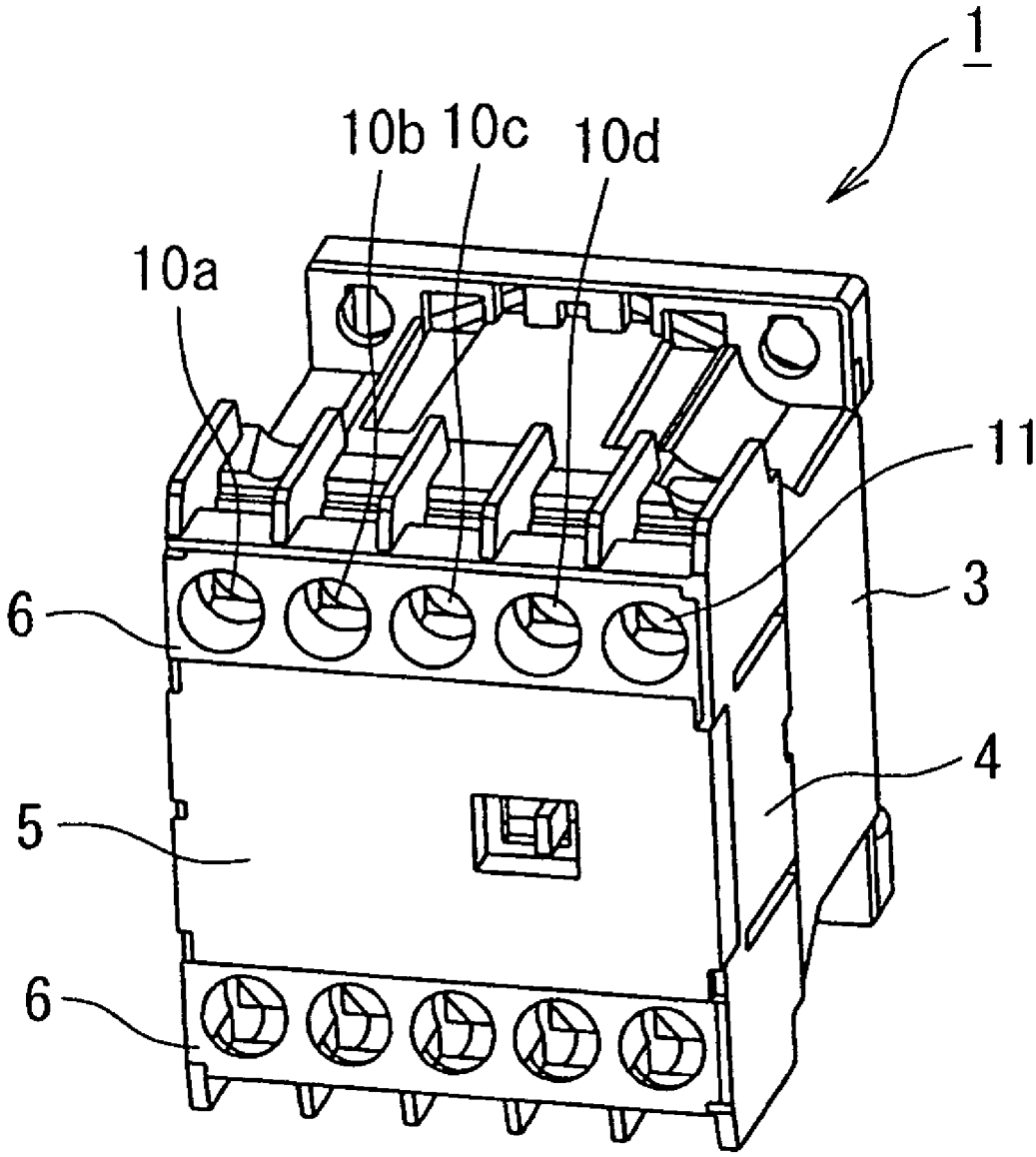
FIG. 1 is a perspective view showing the electromagnetic contact device of a first embodiment of the invention.

Below, a preferred embodiment of the invention (hereafter "embodiment") is explained in detail, referring to the drawings.

As shown in FIG. 1, the electromagnetic contact device 1 of this embodiment comprises a lower case 3 and an upper case 4, formed from a synthetic resin having insulating properties.

In the upper case 4, terminal portions 10*a* to 10*d*, each having contact points, and the coil terminal 11 of an electromagnet are arranged. On the upper case 4, an extinction cover 5, which accommodates in a sealed state a movable contact point support 7*a*, described below, and a terminal cover 6 which covers the terminal portions 10*a* to 10*d* each having contact points and the coil terminal 11 of the electromagnet, are mounted.

Figure 2:
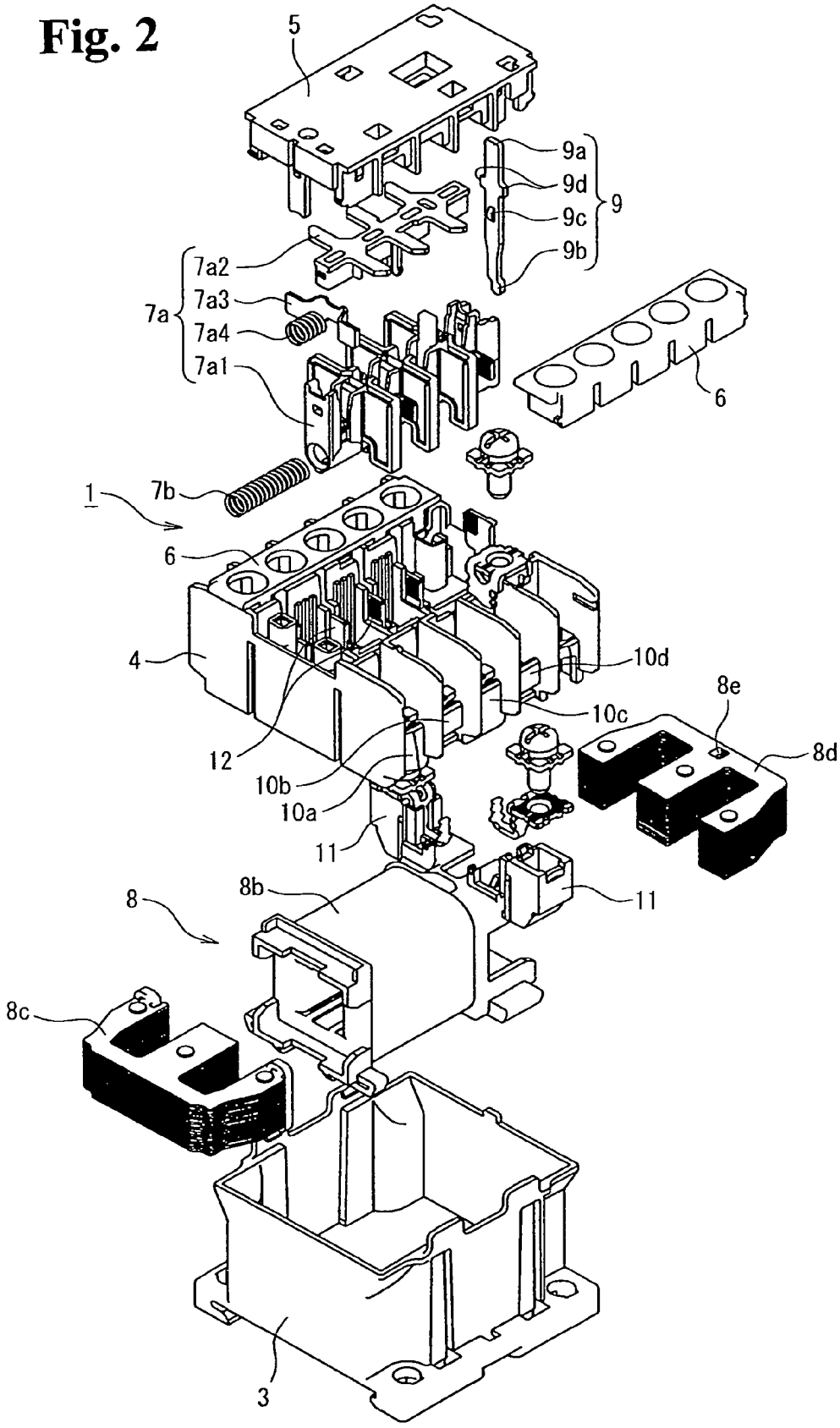
FIG. 2 is an exploded perspective view showing constituent members of an electromagnetic contact device.

Within the upper case 4 are accommodated the movable contact point support 7*a* and return spring 7*b*, shown in FIG. 2.

The movable contact point support 7*a* comprises a movable contact point support base 7*a*1, and a movable contact point support cover 7*a*2 which adheres and joins to this movable contact point support base 7*a*1; on the movable contact point support base 7*a*1, a plurality of sets of combinations of movable contact points 7*a*3 and contact springs 7*a*4 are mounted. Further, on the terminal portions 10*a* to 10*d* each having contact points mounted on the upper case 4 are provided contact point pieces 12; fixed contact points (not shown) provided on these contact point pieces 12 oppose each of the movable contact points 7*a*3.

Further, within the lower case 3 is accommodated an AC-operation type electromagnet 8, as shown in FIG. 2. This electromagnet 8 comprises a coil frame 8*b* which an excitation coil 8*a* is wound around (see FIG. 3); a fixed core 8*c* inserted into a hollow portion of the coil frame 8*b* and fixed to a side wall of the lower case 3; a movable core 8*d* arranged in opposition to and capable of contacting and separating from the fixed core 8*c*, and inserted into a hollow portion of the coil frame 8*b*; and a pair of coil terminals 11 formed integrally and mutually separated on the end of the coil frame 8*b* at which the movable core 8*d* is arranged. The pair of coil terminals 11 is arranged in a row with the terminal portions 10*a* to 10*d* each of which has contact points mounted within the upper case 4.

Figure 3:
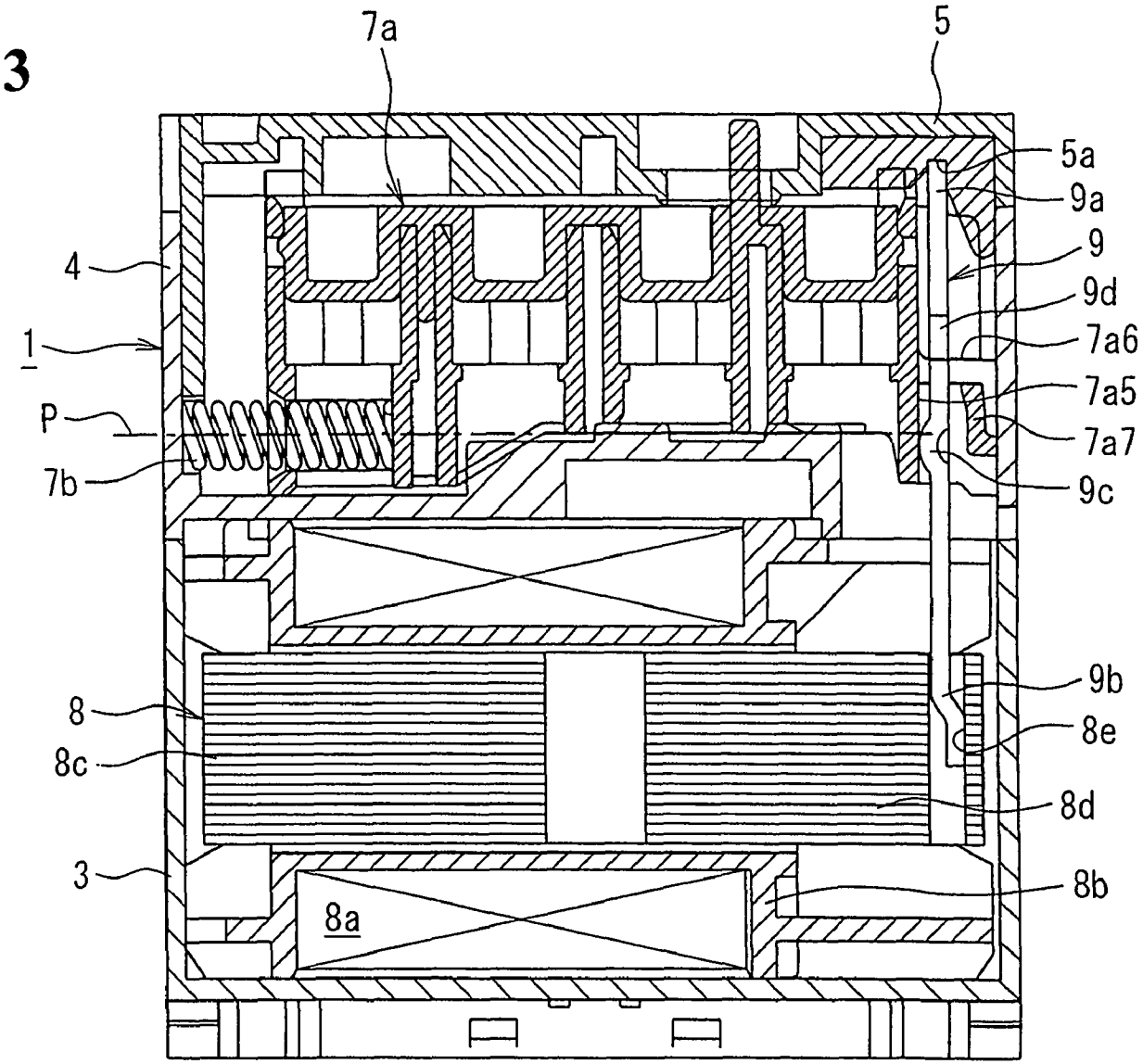
FIG. 3 is a cross-sectional view showing the initial state of an electromagnetic contact device.

As shown in FIG. 3, the movable contact point support 7*a* accommodated within the upper case 4 and electromagnet 8 accommodated within the lower case 3 are arranged such that the moving direction of open and close operation of the movable contact point support 7*a* and the moving direction of the movable core 8*d* (attraction movement direction and release movement direction) are parallel, and in addition the return spring 7*b* is arranged so as to act with a urging force in the direction causing the movable contact point support 7*a* to return to the initial position.

Further, in order to transmit the attraction movement and release movement of the movable core 8*d* to the movable contact point support 7*a*, a driving lever 9, conjoined with one end of the movable contact point 7*a* separated from the return spring 7*b* and with the movable core 8*d*, is extended and accommodated between the lower case 3 and the upper case 4, as shown in FIG. 3.

The driving lever 9 is a plate-shape member, and as shown in FIG. 2, one end in the length direction is a rotation support point portion 9*a*, and a movable core conjoining portion 9*b* is formed on another end in the length direction; in the center in the length direction a movable contact point support conjoining portion 9*c* is provided, and a pair of supported portions 9*d* is formed at a position closer to the side of the rotation support point portion 9*a* than the movable contact point support conjoining portion 9*c*.

Figure 7:
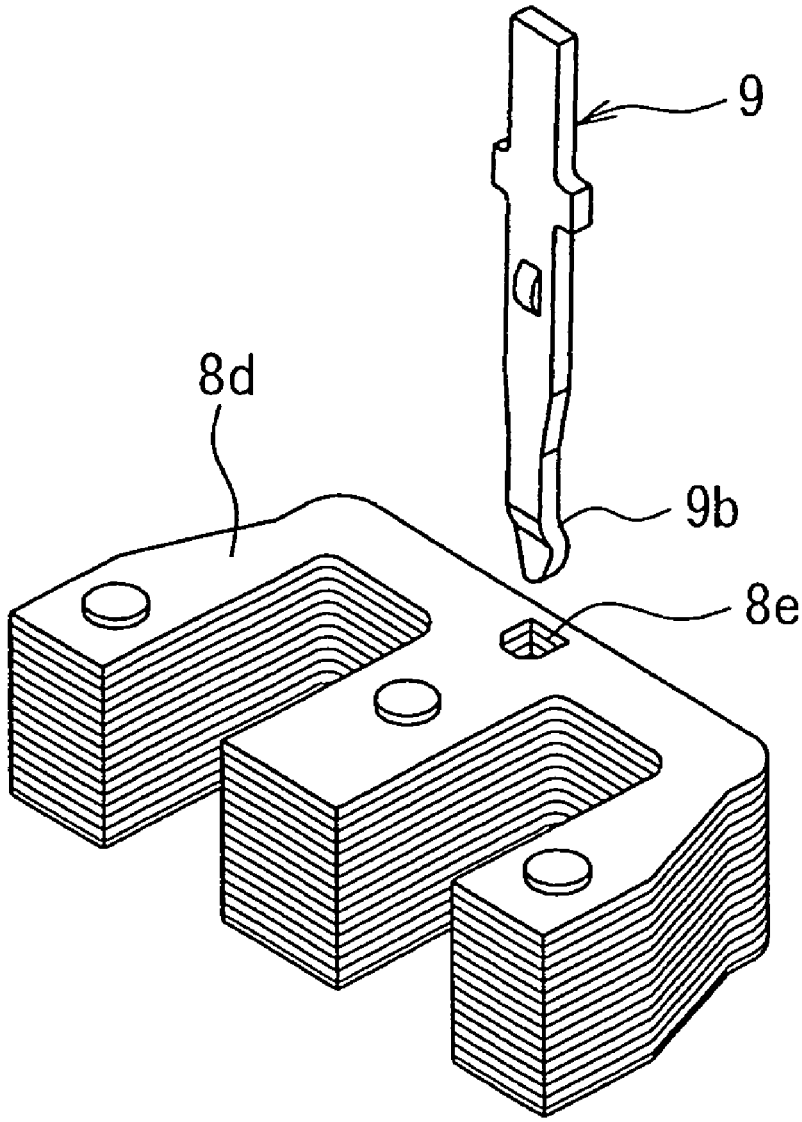
FIG. 7 is a perspective view showing the structure of the movable core and the structure conjoining with the driving lever, comprised by an electromagnetic contact device.

As shown in FIG. 7, the movable core conjoining portion 9*b* of the driving lever 9 is inserted from above into and conjoined with a conjoining hole 8*e* formed in the movable core 8*d*.

Figure 8:
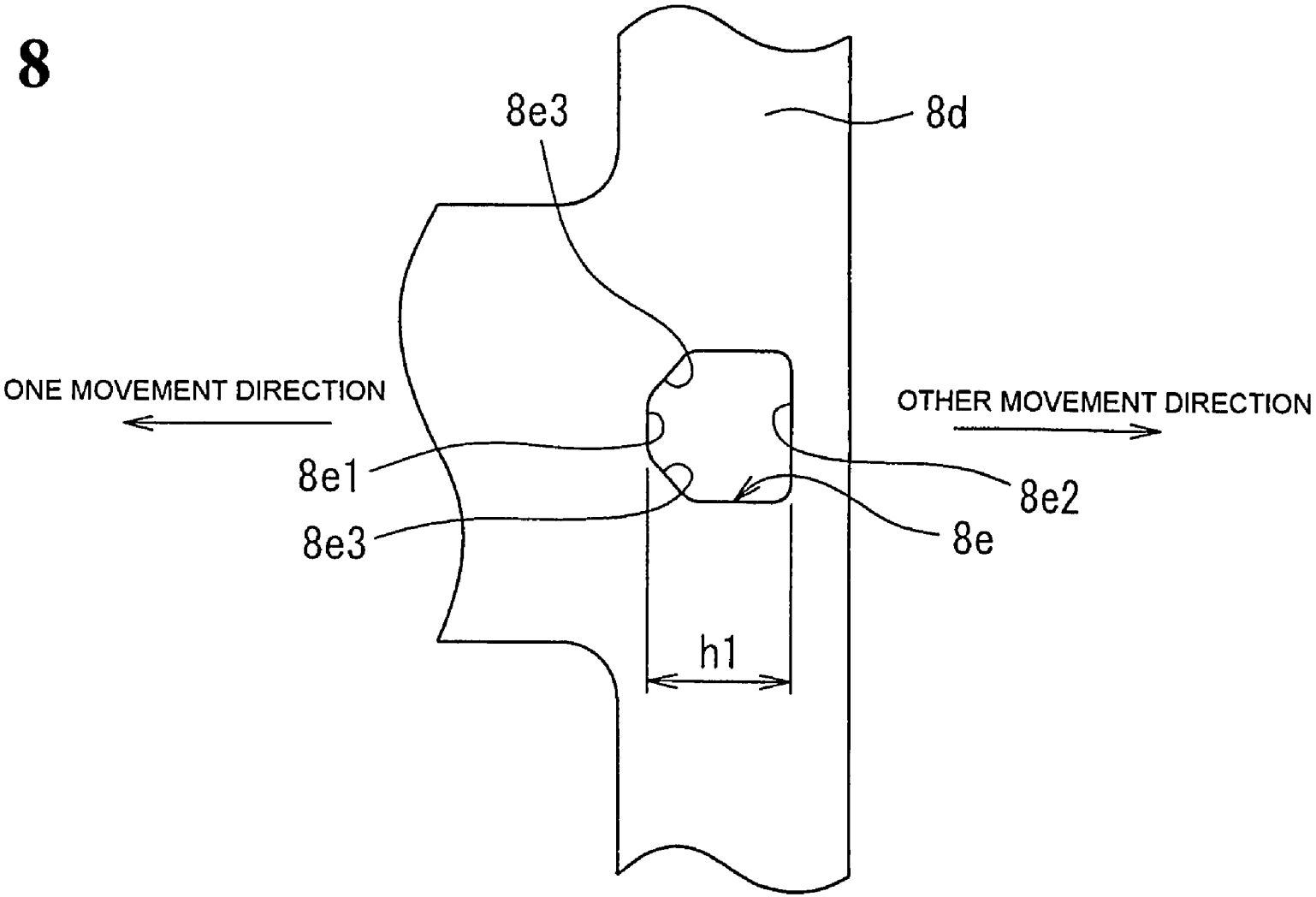
FIG. 8 shows the structure of a movable core engaging hole provided in the movable core comprising an electromagnetic contact device.

Viewing the movable core 8*d* from above as shown in FIG. 8, the conjoining hole 8*e* is formed as a hexagonal hole in which a first inner face 8*e*1 provided in one moving direction of the movable core 8*d* has an inside width (width perpendicular to the movement direction) smaller than a second inner face 8*e*2 provided in the other movement direction of the movable core 8*d*, and with an inclined face 8*e*3 continuous from the first inner face 8*e*1 and inclined on the side of the second inner face 8*e*2 provided.

Figure 9A:
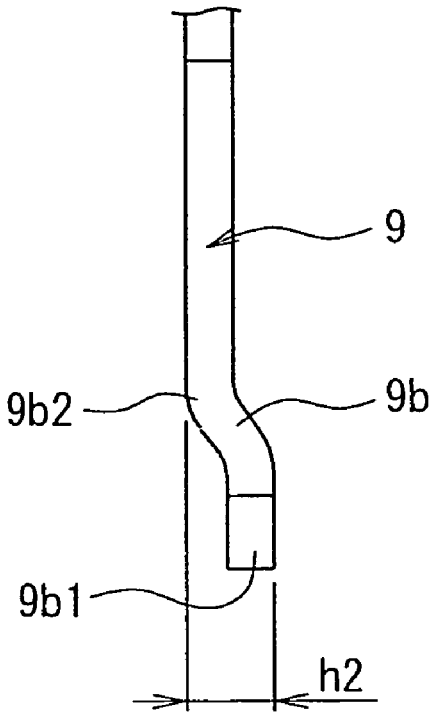
FIG. 9 shows the state of another end of the driving lever comprising an electromagnetic contact device.
Figure 9B:
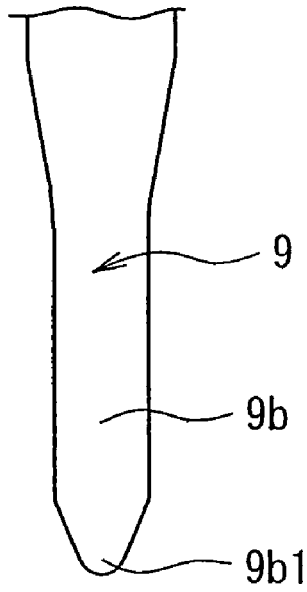

As shown in FIG. 9, the movable core conjoining portion 9*b* has a narrow tip portion 9*b*1 formed by gradually narrowing the plate width, and by providing a bent portion 9*b*2, the width h2 to the tip portion 9*b*1 is set to a slightly smaller value than the hole width h1 (see FIG. 8) between the first inner face 8*e*1 and the second inner face 8*e*2 of the conjoining hole 8*e*.

The movable contact point support conjoining portion 9*c* of the driving lever 9 is provided with a bulging portion, and passes through a lever conjoining hole 7*a*5 which vertically penetrates one side of the movable contact point support 7*a* as shown in FIG. 3. Here, at the lever conjoining hole 7*a*5 is provided, on the right side in FIG. 3, a lever engaging wall 7*a*7 which can abut the movable contact point support conjoining portion 9*c*.

The pair of supported portions 9*d* of the driving lever 9 protrudes outward from the plate width direction, and as shown in FIG. 3, when the movable contact point support conjoining portion 9*c* passes through the lever conjoining hole 7*a*5 of the movable contact point support 7*a*, rotatably abut the upper-end face 7*a*6 of the movable contact point support 7*a*.

As shown in FIG. 3, the rotation support point portion 9*a* of the driving lever 9 enters a support point recess 5*a* provided in the lower face of the extinction cover 5 and rotatably conjoined. And, when the extinction cover 5 is mounted on the upper case 4, the support point recess 5*a* holds the rotation support point portion 9*a* of the driving lever 9, and in addition presses the pair of supported portions 9*d* against the upper-end face 7*a*6 of the movable contact point support 7*a*.

In this way, with the rotation support point portion 9*a* rotatably conjoined with the support point recess 5*a* of the extinction cover 5, and with the movable core conjoining portion 9*b* conjoined with the conjoining hole 8*e* of the movable core 8*d*, movement of the movable core 8*d* is accompanied by rotation of the driving lever 9 with the rotation support point portion 9*a* as a rotation support point, and rotation of this driving lever 9 is transmitted to the movable contact point support 7*a* via the movable contact point support conjoining portion 9*c* and the lever conjoining hole 7*a*5.

Here, the movable contact point support conjoining portion 9*c* of the driving lever 9 which is conjoined with the lever conjoining hole 7*a*5 of the movable contact point support 7*a* is positioned on the line of action of the return spring 7*b* (the line extending from the axial line P), as shown in FIG. 3.

The case of this invention corresponds to the lower case 3, the case of this invention corresponds to the upper case 4, the lever holding portion and recess of this invention correspond to the support point recess 5*a*, the movable core engaging hole of this invention corresponds to the conjoining hole 8*e*, the inner faces of the movable core engaging hole of this invention correspond to the first inner face 8*e*1 and second inner face 8*e*2, the first-contact portion of this invention corresponds to the inclined face 8*e*3, the one end portion of the driving lever of this invention corresponds to the rotation support point portion 9*a*, another end portion of the driving lever of this invention corresponds to the movable core conjoining portion 9*b*, and the narrow tip of this invention corresponds to the narrow tip portion 9*b*1.

Next, operation, of the electromagnetic contact device 1 is explained, referring to FIG. 3 through FIG. 6.

When in an electromagnetic contact device 1 of this embodiment, the excitation coil 8*a* of the electromagnet 8 is in the non-excited state, then as shown in FIG. 3, an attractive force does not act between the fixed core 8*c* and the movable core 8*d*, and the movable contact point support 7*a* is moved to the right in FIG. 3 (hereafter called the initial position of the movable contact point support 7*a*) by the urging force of the return spring 7*b*. At this time, the movable contact points 7*a*3 of the a contact points of the movable contact point support 7*a* are separated from the fixed contact points, and the movable contact points 7*a*3 of the b contact points are in contact with the fixed contact points.

Figure 4:
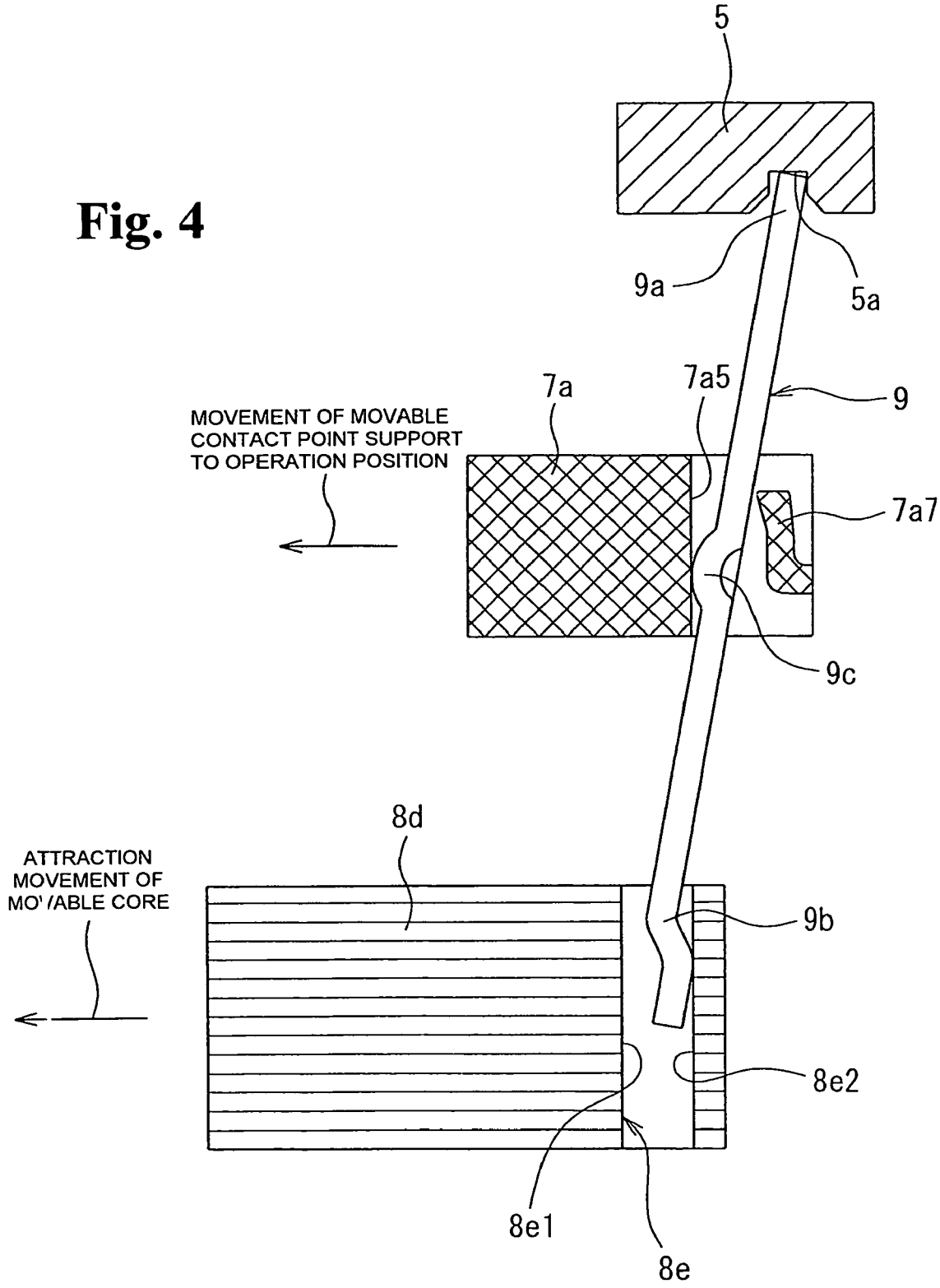
FIG. 4 is a simplified view showing the state of rotation of a driving lever and movement of a movable contact point support to an operation position, when the movable core of an electromagnetic contact device performs attraction movement.

Next, when the excitation coil 8*a* of the electromagnet 8 enters the excited state, an attractive force acts between the fixed core 8*c* and the movable core 8*d*, and the movable core 8*d* undergoes attraction movement toward the fixed core 8*c*. As shown in FIG. 4, when the movable core 8*d* undergoes attraction movement on the left side in the figure, the movable core conjoining portion 9*b* abuts the second inner face 8*e*2 of the conjoining hole 8*e*, and by this means the driving lever 9 undergoes rotation in the clockwise direction with the rotation support point portion 9*a*, engaged with the right-side wall portion of the support point recess 5*a*, as a rotation support point; the movable contact point support 7*a*, pressed by the movable contact point support conjoining portion 9*c*, moves in the operation direction against the return spring 7*b*. When the movable contact point support 7*a* moves to the operation position, the movable contact points 7*a*3 of the a contact points of the movable contact point support 7*a* make contact with the fixed contact points, and the movable contact points 7*a*3 of the b contact points are separated from the fixed contact points.

Figure 5:
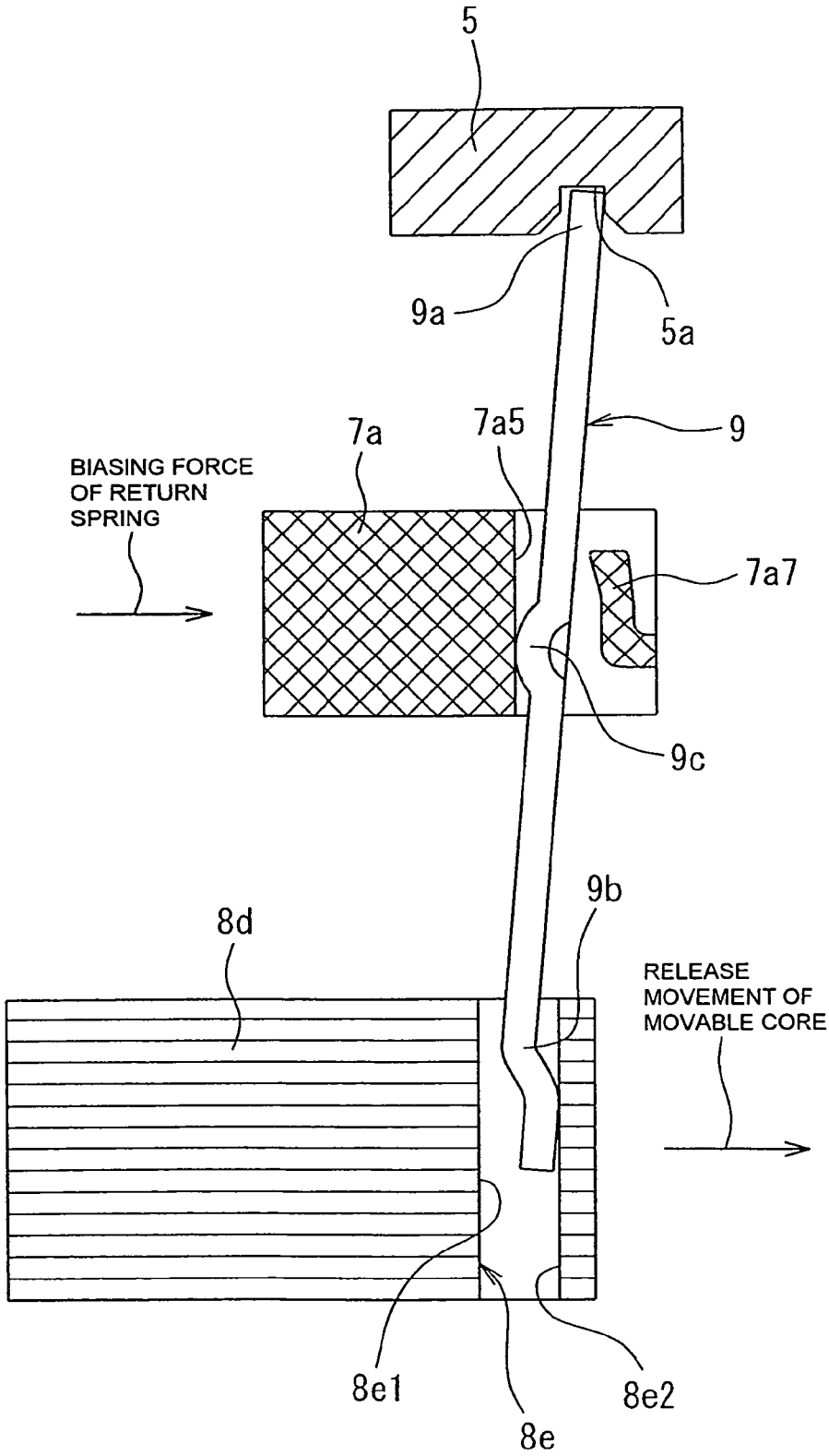
FIG. 5 is a simplified view showing rotation of the driving lever and release movement of the movable core when the movable contact point support of an electromagnetic contact device moves to the initial position due to the urging force of the return spring.

Next, when the excitation coil 8*a* of the electromagnet 8 is put into the non-excited state from the operation position of the movable contact point support 7*a*, the movable contact point support 7*a*, acted on by the urging force of the return spring 7*b*, moves to the initial position as shown in FIG. 5. Further, an external force is transmitted to the movable core-8*d* of the electromagnet 8 via the driving lever 9 from the movable contact point support 7*a* which moves under the urging force of the return spring 7*b*, and due to rotation in the counterclockwise direction of the driving lever 9, the movable core 8*d* undergoes release movement in the direction of separation from the fixed core 8*c*.

If, due to the flow of excessive current, slight adhesion occurs between the movable contact points 7*a*3 of the a contact points of the movable contact point support 7*a* positioned in the operation position and the fixed contact points, then the movable contact point support 7*a*, which has moved toward the initial position due to action of the urging force of the return spring 7*b*, stops midway during release.

Figure 6:
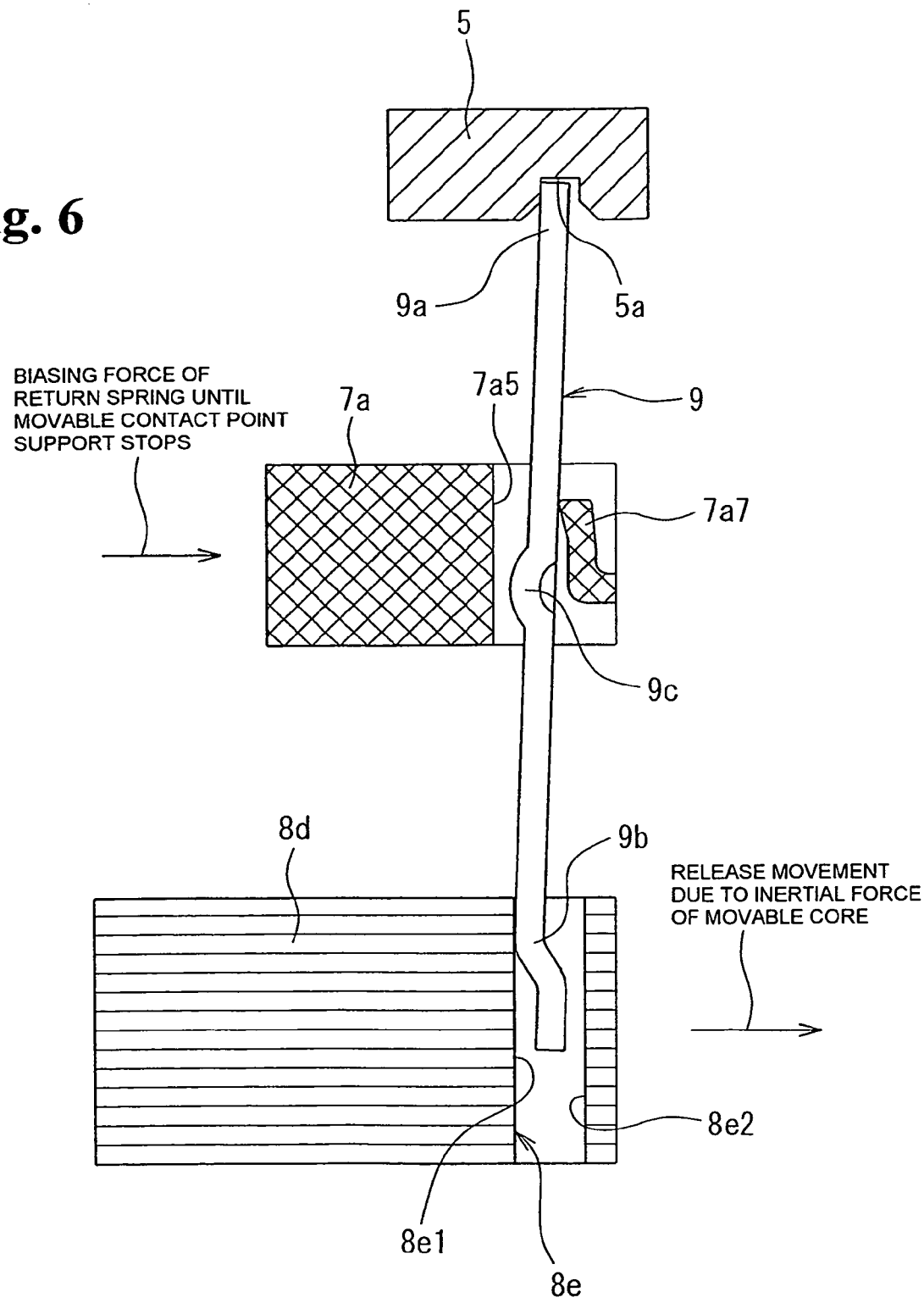
FIG. 6 is a simplified view showing the state of rotation of the driving lever and movement of the movable contact point support to the initial position when the movable core of an electromagnetic contact device performs-release movement due to inertial force.

The urging force of the return spring 7*b* up to where the movable contact point support 7*a* stops is transmitted to the movable core 8*d* via the driving lever 9, so that the movable core 8*d* moves due to inertia in the direction of separation from the fixed core 8*c*, and release movement occurs due to the movement force of this inertia (inertial force). In this way, when the movable core 8*d* undergoes release movement due to inertial force as shown in FIG. 6, the movable core conjoining portion 9*b* of the driving lever 9 abuts the first inner face 8*e*1 of the conjoining hole 8*e* of the movable core 8*d*, and the driving lever 9 rotates in the counterclockwise direction with the rotation support point portion 9*a*, engaged with the wall on the left side of the support point recess 5*a*, as a rotation support point. And, due to the abutting of the lever engaging wall 7*a*7 of the rotation contact point support 7*a* on a portion of the driving lever 9 rotating in the counterclockwise direction, an external force toward the initial position is transmitted to the movable contact point support 7*a*. In this way, when an external force toward the initial position is transmitted to the movable contact point support 7*a*, the movable contact points 7*a*3 of the a contact points and the fixed contact points, between which slight adhesion occurs, are pulled apart, and through the action of the urging force of the return spring 7*b*, the movable contact point support 7*a* moves to the initial position.

Next, advantageous results of this embodiment are explained, referring to the drawings.

As shown in FIG. 3, the rotation support point portion 9*a* provided at one end of the driving lever 9, conjoined with the movable core 8*d* and movable contact point support 7*a*, is rotatably conjoined with the support point recess 5*a* provided in the lower face of the extinction cover 5, in a structure which is freely rotatable with the rotation support point portion 9*a* as a rotation support point; a pin or other rotation holding member fixed to the case, as in a structure of the prior art, is unnecessary, so that the number of components necessary for assembly of the driving lever 9 can be reduced.

Further, when an excessive current flows and there is slight adhesion between the movable contact points 7*a*3 of the a contact points of the movable contact point support 7*a* positioned at the operation position and the fixed contact points, as shown in FIG. 6, the urging force of the return spring 7*b* up until stopping of the movable contact point support 7*a* midway during release is transmitted via the driving lever 9, the movable contact point support 7*a* moves inertially in the direction of separation from the fixed core 8*c*, and release movement occurs due to this inertial force of inertia, so that the driving lever 9 rotates in the counterclockwise direction with the rotation support point portion 9*a* as a rotation support point, and an external force toward the initial position is transmitted to the movable contact point support 7*a*. In this way, through release movement by inertial force of the movable core 8*d*, an external force toward the initial position is transmitted to the movable contact point support 7*a*, and movable contact points 7*a*3 of a contact points and fixed contact points, which are in slight adhesion, are immediately pulled apart, so that slight contact point adhesion can be eliminated in normal operation of the electromagnetic contact device.

Further, as shown in FIG. 3, the movable contact point support conjoining portion 9*c* of the driving lever 9 conjoined with the lever conjoining hole 7*a*5 of the movable contact point support 7*a* is positioned on the line of action (line extending from the axial line P) of the return spring 7*b*, so that no moment acts on the movable contact point support 7*a* to which force is transmitted from the points of action of the return spring 7*b* and driving lever 9, the sliding friction of the movable contact point support 7*a* with the inside of the upper case 4 can be reduced, and the durability of the movable contact point support 7*a* can be improved.

Further, as shown in FIG. 8, an inclined face 8*e*3 is provided in the conjoining hole 8*e* of the movable core 8*d* on the side in one movement direction, and as shown in FIG. 6, when the movable core 8*d* undergoes release movement due to inertial force, the movable core conjoining portion 9*b* comes into contact with the inclined face 8*e*3 before the first inner face 8*e*1, so that movement responsiveness of the movable contact point support 7*a* when the movable core 8*d* undergoes release movement due to inertial force can be improved.

Further, as shown in FIG. 9(*b*), the movable core conjoining portion 9*b* of the driving lever 9 comprises a narrow tip portion 9*b*1, so that operation to insert the movable core conjoining portion 9*b* toward the conjoining hole 8*e* of the movable core 8*d* can easily be performed.

Further, as shown in FIG. 8 and FIG. 9(*a*), in the movable core conjoining portion 9*b* of the driving lever 9, the width h2 from the bent portion 9*b*2 to the tip portion 9*b*1 is set to a value slightly smaller than the hole width h1 between the first inner face 8*e*1 and the second inner face 8*e*2 of the conjoining hole 8*e* of the movable core 8*d*, and when the movable core 8*d* moves in the attraction direction and the release direction, rotation operation of the driving lever 9 is immediately transmitted from the first inner face 8*e*1 or the second inner face 8*e*2 via the movable core conjoining portion 9*b*, so that movement responsiveness of the movable contact point support 7*a* can be improved.

Further, as shown in FIG. 3, the support point recess 5*a* formed in the extinction cover 5 envelops and supports the rotation support point portion 9*a* which is one end of the driving lever 9, so that the rotation support point portion 9*a* can be axially supported by a simple structure.

INDUSTRIAL APPLICABILITY

As explained above, an electromagnetic contact device of this invention is useful for enabling elimination by normal operation of problems of slight adhesion of contact point portions due to the flow of excessive currents, and for the easy assembly of the driving lever which links the movable contact point support and the electromagnet.

EXPLANATION OF REFERENCE NUMERALS

1 Electromagnetic contact device
3 Lower case
4 Upper case
5 Extinction cover
5*a* Support point recess
6 Terminal cover
7*a* Movable contact point support
7*a*1 Movable contact point support base
7*a*2 Movable contact point support cover
7*a*3 Movable contact point
7*a*4 Contact spring
7*a*5 Lever conjoining hole
7*b* Return spring
7*a*6 Upper-end face
7*a*7 Lever engaging wall
8 Electromagnet
8*a* Excitation coil
8*b* Coil frame
8*c* Fixed core
8*d* Movable core
8*e* Conjoining hole
8*e*1 First inner face
8*e*2 Second inner face
8*e*3 Inclined face
9 Driving lever
9*a* Rotation support point portion
9*b* Movable core conjoining portion
9*b*1 Tip portion
9*b*2 Bent portion
9*c* Movable contact point support conjoining portion
9*d* Supported portion
10*a*-10*d* Terminal portion
11 Coil terminal
12 Contact point piece
P Return spring axial line

What is claimed is:

1. An electromagnetic contact device comprising, a case accommodating an electromagnet having a movable core for attraction movement and release movement; a movable contact point support moving between an initial position and an operation position in parallel with a moving direction of the movable core; a return spring urging said movable contact point support toward the initial position; and a driving lever engaging the movable core and the movable contact point support, and transmitting the attraction movement of the movable core to the movable contact point support as a moving force toward the operation position, wherein a lever holding portion is formed in an inner wall of an extinction cover, and by mounting said extinction cover on the case and having the lever holding portion to axially support one end of the driving lever, the driving lever is accommodated such that another end thereof engaged with the movable core and movable contact point support rotates with the one end as a rotation support point; and when the movable contact point support stops midway during release, the release movement from the inertial force of the movable core is transmitted to the movable contact point support through the driving lever as a moving force toward the initial position.

2. An electromagnetic contact device according to claim 1, wherein a point of action of the driving lever transmitting the attraction movement of the movable core to the movable contact point support as the moving force is positioned on a line extending from an axial line of the return spring.

3. An electromagnetic contact device according to claim 1, wherein a movable core engaging hole is arranged in the movable core, and another end of the driving lever is inserted and engaged with said movable core engaging hole; and in the vicinity of an inner face of the movable core engaging hole with which another end is engaged, a first-contact portion abutting against a tip portion before the inner face is formed when the movable core performs the release movement by the inertial force.

4. An electromagnetic contact device according to claim 3, wherein a shape of the tip portion of the driving lever inserted into the movable core engaging hole is shaped to have a narrow tip with an area smaller than an opening area of the movable core engaging hole.

5. An electromagnetic contact device according to claim 3, wherein in order to place the another end of the driving lever proximity to the inner face of the movable core engaging hole positioned in the moving direction of the movable core, another end of the driving lever is bent toward the moving direction of the movable core and inserted into the movable core engaging hole.

6. An electromagnetic contact device according to claim 1, wherein the lever holding portion formed in the inner wall of the extinction cover is a recess supported by entering one end of the driving lever.

* * * * *